US011131118B2

(12) United States Patent
Cohen et al.

(10) Patent No.: US 11,131,118 B2
(45) Date of Patent: Sep. 28, 2021

(54) LATCHBOLT RETRACTOR, A LATCHBOLT ASSEMBLY, AND AN ASSEMBLY FOR A LOCKSET

(71) Applicant: TNBT HOLDINGS PTY LTD, Minchinbury (AU)

(72) Inventors: Marc Cohen, Bellevue Hill (AU); Daniel Mascia, North Parramatta (AU); Zsolt Szarka-Kovacs, Dee Why (AU); Jonathon Woodcock, Bondi Junction (AU)

(73) Assignee: TNBT HOLDINGS PTY LTD, Minchinbury (AU)

( * ) Notice: Subject to any disclaimer, the term of this patent is extended or adjusted under 35 U.S.C. 154(b) by 804 days.

(21) Appl. No.: 15/756,594

(22) PCT Filed: Sep. 2, 2016

(86) PCT No.: PCT/AU2016/050828
§ 371 (c)(1),
(2) Date: Mar. 1, 2018

(87) PCT Pub. No.: WO2017/035597
PCT Pub. Date: Mar. 9, 2017

(65) Prior Publication Data

US 2018/0202190 A1 Jul. 19, 2018

(30) Foreign Application Priority Data

Sep. 2, 2015 (AU) ..... 2015903591

(51) Int. Cl.
*E05B 9/08* (2006.01)
*E05B 3/06* (2006.01)
(Continued)

(52) U.S. Cl.
CPC ..... *E05B 17/2034* (2013.01); *E05B 3/06* (2013.01); *E05B 9/08* (2013.01); *E05B 15/004* (2013.01);
(Continued)

(58) Field of Classification Search
CPC ... Y10T 292/57; Y10T 292/82; Y10T 292/85; Y10T 292/858; Y10T 292/865;
(Continued)

(56) References Cited

U.S. PATENT DOCUMENTS 986,962 A * 3/1911 Blank ..... E05B 55/005 292/169.14
1,230,774 A * 6/1917 Pollock ..... E05B 55/005 292/169.14
(Continued)

FOREIGN PATENT DOCUMENTS

FR 1355736 A * 3/1964 ..... E05B 55/12
GB 904970 A * 9/1962 ..... E05B 3/065
(Continued)

OTHER PUBLICATIONS

International Search Report dated Dec. 2, 2016 in related International Application No. PCT/AU2016/050828.
(Continued)

*Primary Examiner* — Carlos Lugo
(74) *Attorney, Agent, or Firm* — Eric L. Lane; Green Patent Law

(57) ABSTRACT

A latchbolt retractor (12) is described herein. The latchbolt retractor (12) comprises a latchbolt retraction mechanism (30) mounted to a carriage (28). The latchbolt retraction mechanism (30) comprising a latchbolt assembly coupler (32) for operational coupling to a latchbolt assembly (22).
(Continued)

The carriage (28) is configured to slide along at least one rail (14,16) for positioning the latchbolt assembly coupler (32) relative to the latchbolt.

14 Claims, 14 Drawing Sheets

(51) Int. Cl.

| | |
|---|---|
| ***E05B 17/20*** | (2006.01) |
| ***E05B 15/00*** | (2006.01) |
| ***E05C 1/16*** | (2006.01) |
| ***E05B 15/02*** | (2006.01) |
| ***E05B 47/00*** | (2006.01) |
| ***E05B 63/04*** | (2006.01) |
| ***E05B 63/10*** | (2006.01) |
| ***E05B 55/12*** | (2006.01) |
| *E05B 17/00* | (2006.01) |

(52) U.S. Cl.
CPC ..... *E05B 15/0033* (2013.01); *E05B 15/02* (2013.01); *E05B 47/004* (2013.01); *E05B 47/0038* (2013.01); *E05B 55/12* (2013.01); *E05B 63/042* (2013.01); *E05B 63/10* (2013.01); *E05C 1/163* (2013.01); *E05B 17/0075* (2013.01); *Y10T 292/82* (2015.04); *Y10T 292/85* (2015.04); *Y10T 292/91* (2015.04)

(58) Field of Classification Search
CPC ..... Y10T 292/91; Y10T 292/06; Y10T 292/0977; Y10T 292/1022; Y10T 292/103; Y10T 292/1031; E05B 55/12; E05B 17/2034; E05B 3/06; E05B 63/04; Y10S 292/24; Y10S 292/26; Y10S 292/60
USPC ..... 70/141–145, 149, 150, 151 R, 467–489
See application file for complete search history.

(56) References Cited

U.S. PATENT DOCUMENTS

| | | | | | |
|---|---|---|---|---|---|
| 1,568,353 | A * | 1/1926 | Tullis | E05B 63/20 | 292/335 |
| 1,661,454 | A * | 3/1928 | Wilson | E05B 55/005 | 70/448 |
| 2,299,181 | A * | 10/1942 | Schlage | E05B 63/06 | 292/1.5 |
| 2,327,071 | A * | 8/1943 | Schlage | E05B 33/00 | 70/129 |
| 2,481,459 | A * | 9/1949 | Whitney | E05B 65/0858 | 292/153 |
| 2,776,158 | A * | 1/1957 | Unetic | E05B 55/12 | 292/163 |
| 2,953,405 | A * | 9/1960 | Kubik | E05C 1/163 | 292/169.23 |
| 3,014,748 | A * | 12/1961 | Welch | E05B 3/06 | 292/356 |
| 3,020,073 | A * | 2/1962 | Williams | E05C 1/163 | 292/169.21 |
| 3,046,042 | A * | 7/1962 | Kane | E05B 63/06 | 292/1.5 |
| 3,144,266 | A * | 8/1964 | Schmid | E05B 55/005 | 292/169.13 |
| 3,876,236 | A * | 4/1975 | Best | E05B 55/12 | 292/169.13 |
| 4,272,974 | A * | 6/1981 | Hennessy | E05B 63/0017 | 70/129 |
| 4,428,212 | A * | 1/1984 | Best | E05B 17/007 | 292/169.15 |
| 4,594,864 | A * | 6/1986 | Hart | E05B 55/005 | 70/143 |
| 4,729,586 | A * | 3/1988 | Fang | E05B 63/06 | 292/1.5 |
| 4,736,973 | A * | 4/1988 | Fang | E05B 63/06 | 292/1.5 |
| 4,744,232 | A * | 5/1988 | Shen | E05B 63/06 | 292/1 |
| 4,750,766 | A * | 6/1988 | Shen | E05B 63/06 | 292/1.5 |
| 4,988,136 | A * | 1/1991 | Gressett, Jr. | E05B 3/065 | 292/244 |
| 4,998,760 | A * | 3/1991 | Nixon | E05B 3/065 | 292/336.3 |
| 5,020,343 | A * | 6/1991 | Hart | E05B 55/005 | 70/143 |
| 5,067,758 | A * | 11/1991 | Fann | E05B 3/065 | 292/347 |
| 5,335,948 | A * | 8/1994 | Norton, II | E05B 3/065 | 292/169.23 |
| 5,385,374 | A * | 1/1995 | Fann | E05B 55/005 | 292/336.3 |
| 5,433,497 | A * | 7/1995 | Koenig | E05B 13/002 | 292/169.14 |
| 5,456,503 | A * | 10/1995 | Russell, IV | E05B 63/06 | 292/1.5 |
| 5,613,715 | A * | 3/1997 | Kim | E05B 63/06 | 292/1.5 |
| 5,617,749 | A * | 4/1997 | Park | E05B 3/065 | 292/336.3 |
| 5,690,372 | A * | 11/1997 | Jans | E05B 63/0021 | 292/169 |
| 5,761,936 | A * | 6/1998 | Katayama | E05B 3/065 | 292/336.3 |
| 5,904,232 | A * | 5/1999 | Shen | E05B 13/101 | 192/69.62 |
| 6,186,562 | B1 * | 2/2001 | Huang | E05B 55/005 | 292/169 |
| 6,279,360 | B1 * | 8/2001 | Shen | E05B 3/06 | 70/224 |
| 6,540,274 | B2 * | 4/2003 | Bates | E05C 1/163 | 292/169.23 |
| 6,742,820 | B2 * | 6/2004 | Shen | E05B 55/005 | 292/336.3 |
| 7,748,758 | B2 * | 7/2010 | Fang | E05B 55/005 | 292/347 |
| 7,934,754 | B2 * | 5/2011 | Mathachan | E05B 55/005 | 292/347 |
| 8,047,586 | B2 * | 11/2011 | Pilotelli | E05B 63/006 | 292/357 |
| 8,182,005 | B2 * | 5/2012 | Liu | E05B 55/005 | 292/347 |
| 10,006,226 | B2 * | 6/2018 | Hill | E05B 55/005 | |
| 2002/0020038 | A1 * | 2/2002 | Wilkes | E05B 3/06 | 16/412 |
| 2008/0111384 | A1 * | 5/2008 | Ellis | E05B 3/065 | 292/336.3 |
| 2008/0179892 | A1 | 7/2008 | Yuan | | |
| 2009/0152875 | A1 * | 6/2009 | Gray | E05B 55/005 | 292/1.5 |
| 2018/0238081 | A1 * | 8/2018 | Monaghan | E05B 15/02 | |

FOREIGN PATENT DOCUMENTS

| | | | | |
|---|---|---|---|---|
| GB | 1085059 | A | 9/1967 | |
| GB | 1220187 | A | 1/1971 | |
| WO | WO-8402945 | A1 * | 8/1984 | E05B 55/00 |
| WO | WO-2013050915 | A1 * | 4/2013 | E05B 3/065 |

OTHER PUBLICATIONS

Written Opinion dated Dec. 2, 2016 in related International Application No. PCT/AU2016/050828.

* cited by examiner

LATCHBOLT RETRACTOR, A LATCHBOLT ASSEMBLY, AND AN ASSEMBLY FOR A LOCKSET

TECHNICAL FIELD

The disclosure herein generally, but not necessarily, relates to a latchbolt retractor, a latchbolt assembly, and an assembly for a lockset.

BACKGROUND

Locksets, including leversets, are commonly found on hinged barriers including but not limited to doors and gates. Their ease of installation contribute to their popularity. There are some aspects of locksets, however, that are less than ideal.

SUMMARY

Disclosed herein is a latchbolt retractor. The latchbolt retractor comprises a latchbolt retraction mechanism mounted to a carriage. The latchbolt retraction mechanism comprising a latchbolt assembly coupler for operational coupling to a latchbolt assembly. The carriage is configured to slide along at least one rail for positioning the latchbolt assembly coupler relative to the latchbolt assembly.

In an embodiment, the carriage comprises at least one bearing configured to engage the at least one rail.

In an embodiment, the at least one rail comprises a plurality of rails and the carriage comprises a plurality of bearings configured to engage the plurality of rails. The plurality of bearings may each only fit a respective rail of the plurality of rails.

In an embodiment, the at least one rail and the at least one bearing are configured for a unique rotational orientation of the latchbolt retraction mechanism about an axis parallel to the at least rail when the at least one bearing engages the at least one rail. The latchbolt retraction mechanism may comprise a rotatable actuator and is configured to retract the latchbolt assembly coupler when the rotatable actuator is rotated in one direction only.

In an embodiment, the latchbolt retraction mechanism is configured to be operationally coupled to a handle.

In an embodiment, the rotatable actuator is operationally coupled to the latchbolt assembly coupler via a rack-and-pinion.

In an embodiment, the carriage comprises a carriage housing in which the retraction mechanism is mounted. The at least one bearing may be formed in the housing.

In an embodiment, the latchbolt assembly coupler comprises an inwardly orientated convex surface for pulling a latchbolt actuator of the latchbolt assembly. The latchbolt assembly coupler may comprise a bar having the inwardly oriented convex surface for pulling the latchbolt actuator of the latchbolt assembly.

Optionally, an embodiment comprises a latchbolt retractor actuator and the latchbolt retractor comprises a ferromagnetic element fixed therein that is magnetically attracted the latchbolt retractor actuator.

Disclosed herein is a latchbolt assembly. The latchbolt assembly comprises a latchbolt. The latchbolt assembly comprises a latchbolt actuator joined to the latchbolt via a sliding joint having a sliding limit. The latchbolt actuator is configured for operational coupling to a latchbolt retraction mechanism. The latchbolt assembly comprises a movable stop biased into the latchbolt actuator and arranged to interfere with the latchbolt to stop an inward movement thereof. The latchbolt actuator is configured to move the movable stop clear of the latchbolt when operated and the sliding joint is approaching the sliding limit.

In an embodiment, the latchbolt comprises a stop receiver and the latchbolt actuator comprises a ramp. The movable stop may be arranged to interfere with the stop receiver to stop an inward movement of the latchbolt. The ramp may be arranged to move the movable stop clear of the stop receiver when the latchbolt actuator is operated and the sliding joint is approaching the sliding limit. The latchbolt may comprise an elongated member extending from a head of the latchbolt and comprising the stop.

In an embodiment, the latchbolt actuator comprises a latchbolt retraction mechanism coupler for operationally coupling to the latchbolt retraction mechanism. The latchbolt retraction mechanism coupler may be configured to fix the position the latchbolt retraction mechanism relative to the latchbolt assembly when so coupled. The latchbolt retraction mechanism coupler may comprise at least one laterally displaced element. A latchbolt assembly coupler of the latchbolt retraction mechanism is received between the at least one laterally displaced element and a body of the latchbolt actuator. The plurality of laterally spaced apart elements may interfere with lateral displacement of latchbolt retraction mechanism when so coupled.

Disclosed herein is an assembly for a lockset. The assembly comprises a latchbolt retractor in accordance with the above disclosure mounted on the at least one rail. The at least one rail extends between two plates configured to be attached to opposite sides of a hinged barrier. The assembly comprises a latchbolt assembly operationally coupled to the latchbolt retractor.

In an embodiment, the latchbolt assembly is in accordance with the above disclosure.

In an embodiment, the latchbolt retractor and the latchbolt assembly are configured to fix the latchbolt retraction mechanism at the latchbolt assembly.

In an embodiment, the latchbolt assembly comprises at least one laterally displaced element. The latchbolt coupler of the latchbolt retraction mechanism may be received between the at least one laterally displaced element and a body of a latchbolt actuator of the latchbolt assembly. The at least one laterally displaced element and the body may interfere with lateral displacement of the latchbolt retraction mechanism.

An embodiment comprises a joint having a curved surface at which the latchbolt assembly and the latchbolt retractor are joined.

In an embodiment, the latchbolt retractor is configured to be operationally coupled to a handle.

Disclosed herein is an assembly for a lockset. The assembly comprises a housing. The assembly comprises a handle coupler housed at least in part within the housing and rotationally mounted thereto. The handle coupler is configured for a handle to be coupled thereto and transmit rotation of the handle when so coupled. The assembly comprises a plate for mounting on a hinged barrier and having a preferred orientation relative to the hinged barrier when so mounted. The housing is attachable to the plate in an orientation and an inverted orientation. The plate and the handle coupler are configured to interfere to stop rotation of the handle coupler in a direction when the housing is attached in the orientation, and stop rotation of the handle coupler in a counter-direction when the housing is attached in the inverted orientation.

In an embodiment, one of the handle coupler and the plate comprises two interference members and the other of the handle coupler and the plate comprises a corresponding interference member. When the housing is attached in the orientation one of the two interference members is disposed to interfere with the corresponding interference member to stop rotation of the handle coupler in a direction and when the housing is attached in the inverted orientation the other of the two interference members is disposed to interfere with the corresponding interference member to stop rotation of the handle coupler in the counter-direction.

In an embodiment, the two interference members are disposed at one side of the one of the handle coupler of the plate.

In an embodiment, the preferred orientation is indicated on the plate.

An embodiment comprises a bar coupled to the handle coupler for transmission of the rotation of the handle to a latchbolt retractor.

In an embodiment, the latchbolt retractor is in accordance with the above disclosure.

In an embodiment, the housing comprises a rose.

In an embodiment, the plate comprises a feature indicative of the preferred orientation.

In an embodiment, the plate has at least two apertures for fasteners for fixing the plate to a hinged barrier. The plate may have at least four apertures for fasteners for fixing the plate to a hinged barrier.

Any of the various features of each of the above disclosures, and of the various features of the embodiments described below, can be combined as suitable and desired.

BRIEF DESCRIPTION OF THE FIGURES

Embodiments will now be described by way of example only with reference to the accompanying figures in which.

DESCRIPTION OF EMBODIMENTS

Figure 1:
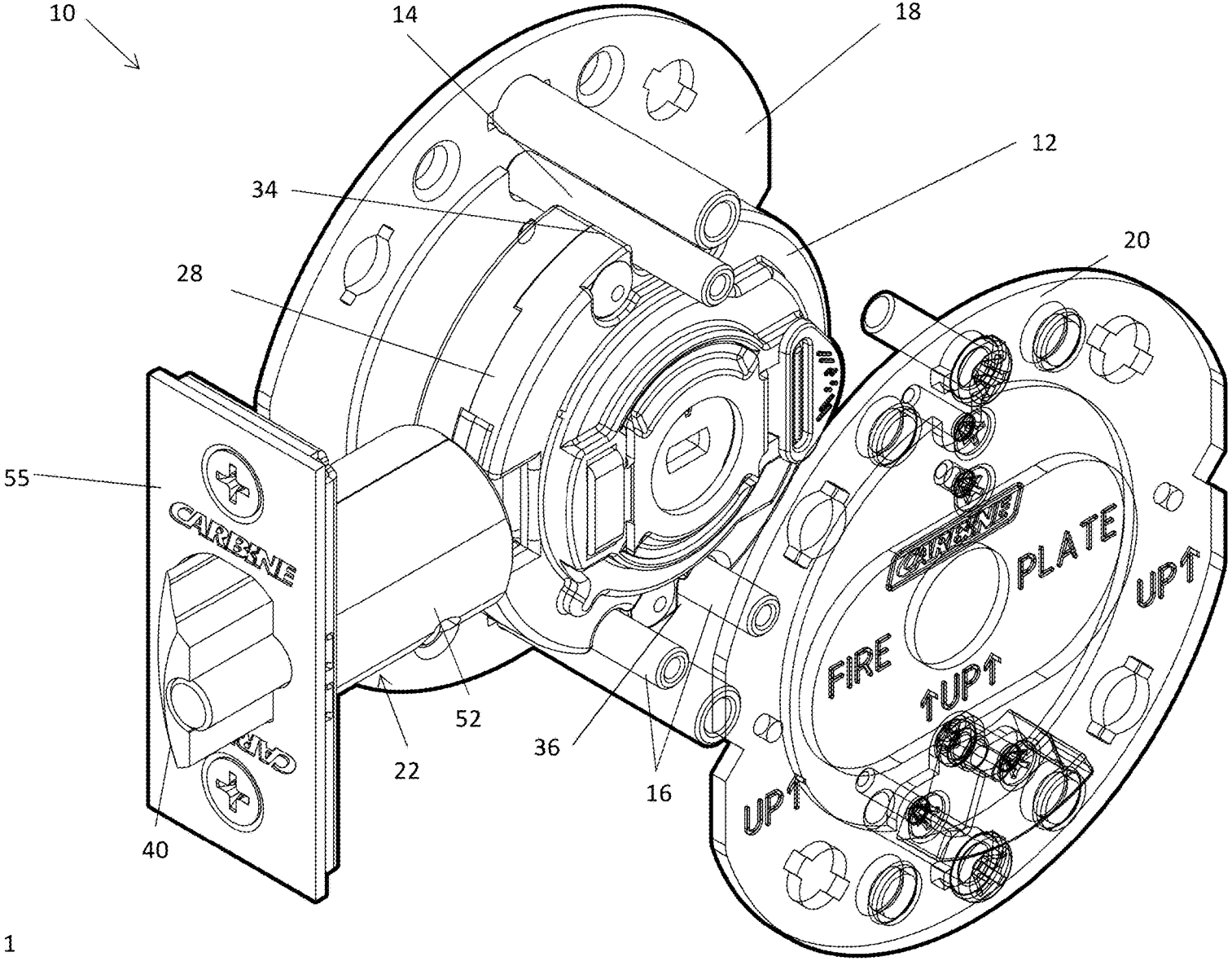
FIG. 1 shows a perspective view of an embodiment of an assembly for a lockset.

FIG. 1 shows a perspective view of an embodiment of an assembly for a lockset, the assembly being generally indicated by the numeral 10. The assembly 10 has a latchbolt retractor 12. The latchbolt retractor 12 is mounted on the at least one rail, in this embodiment a plurality of rails 14,16 (specifically two in this embodiment, but an alternative embodiment may have more or less rails). The at least one rail 14,16 extends between two plates 18,20 which are configured to be attached to opposite sides of a hinged barrier in for form of, for example, a door or gate. The assembly 10 has a latchbolt assembly 22 operationally coupled to the latchbolt retractor 12.

Figure 2:
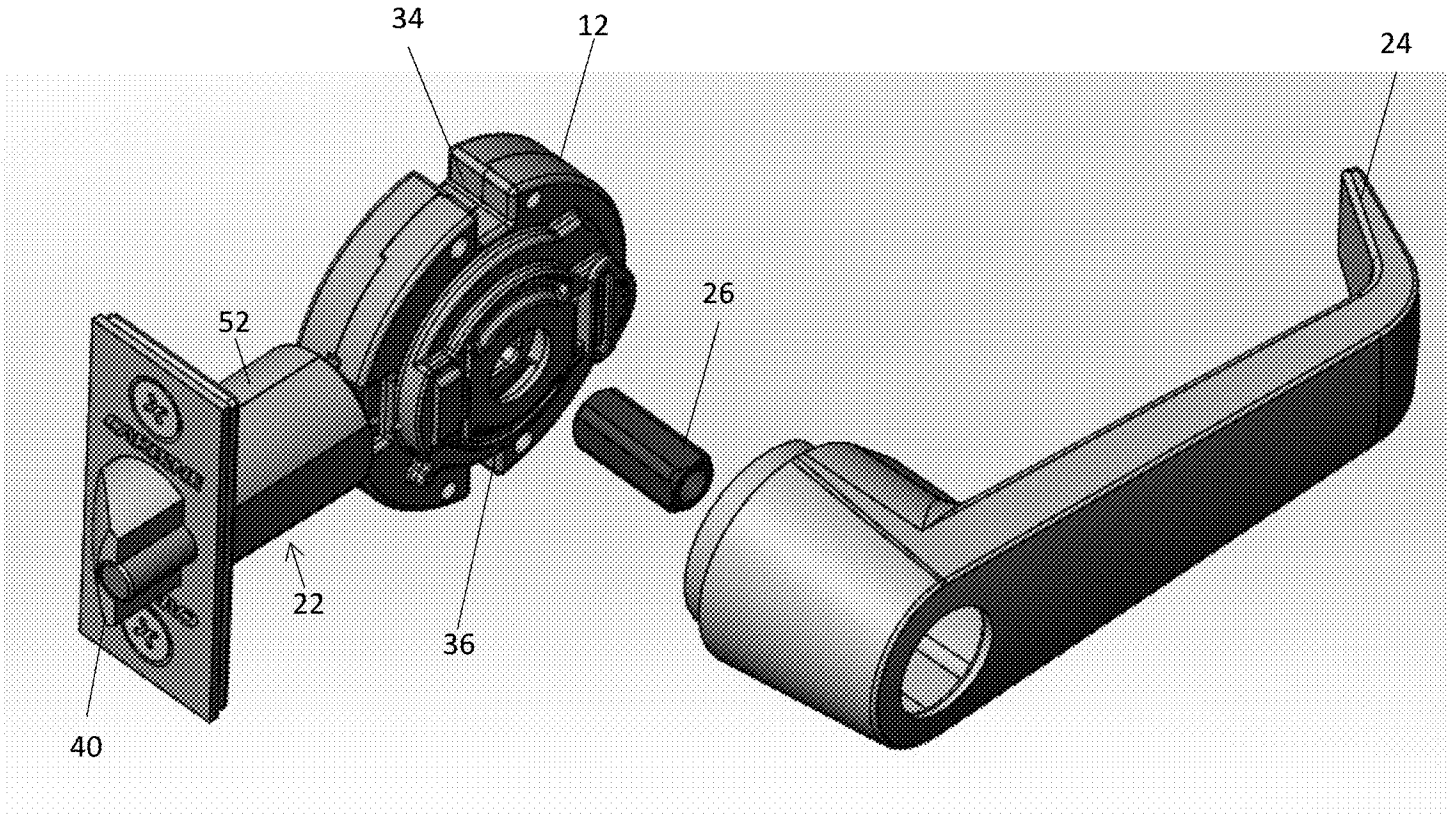
FIG. 2 shows a perspective view of a latchbolt retractor and a latchbolt assembly of an assembly for a lockset of FIG. 1, and an example of a handle in the form of a lever for operational coupling to the latchbolt retractor.

FIG. 2 shows a perspective view of the latchbolt retractor 12 and the latchbolt assembly 22 of FIG. 1 together and a handle 24 in the form of a lever for operational coupling to the latchbolt retractor 12. An alternative embodiment may have any suitable form of handle, for example a knob. The latchbolt retractor 12 may be disposed in a face bore of the hinged barrier. The latchbolt assembly may be disposed in an edge bore of the hinged barrier, the edge bore opening into the face bore. A coupling in the form of a latchbolt retractor actuator 26 is operationally coupled to both the latchbolt retractor 12 and the handle 24, the coupling being for transmitting rotation of the handle to the latchbolt retractor 12. The latchbolt retraction mechanism 30 comprises, in some but not all embodiments, a rotatable actuator 38. The latchbolt retractor actuator 26 has a square profile and is engaged by the rotatable actuator 38 of the latchbolt retractor 12 (FIG. 3) and an actuator engager 80 (FIG. 15) operationally coupled to the handle 24. Alternatively, the profile of the latchbolt may be rectangular, octagonal, irregular or generally any suitable engaging profile. In another embodiment, the latchbolt retraction mechanism is integrated.

Figure 3:
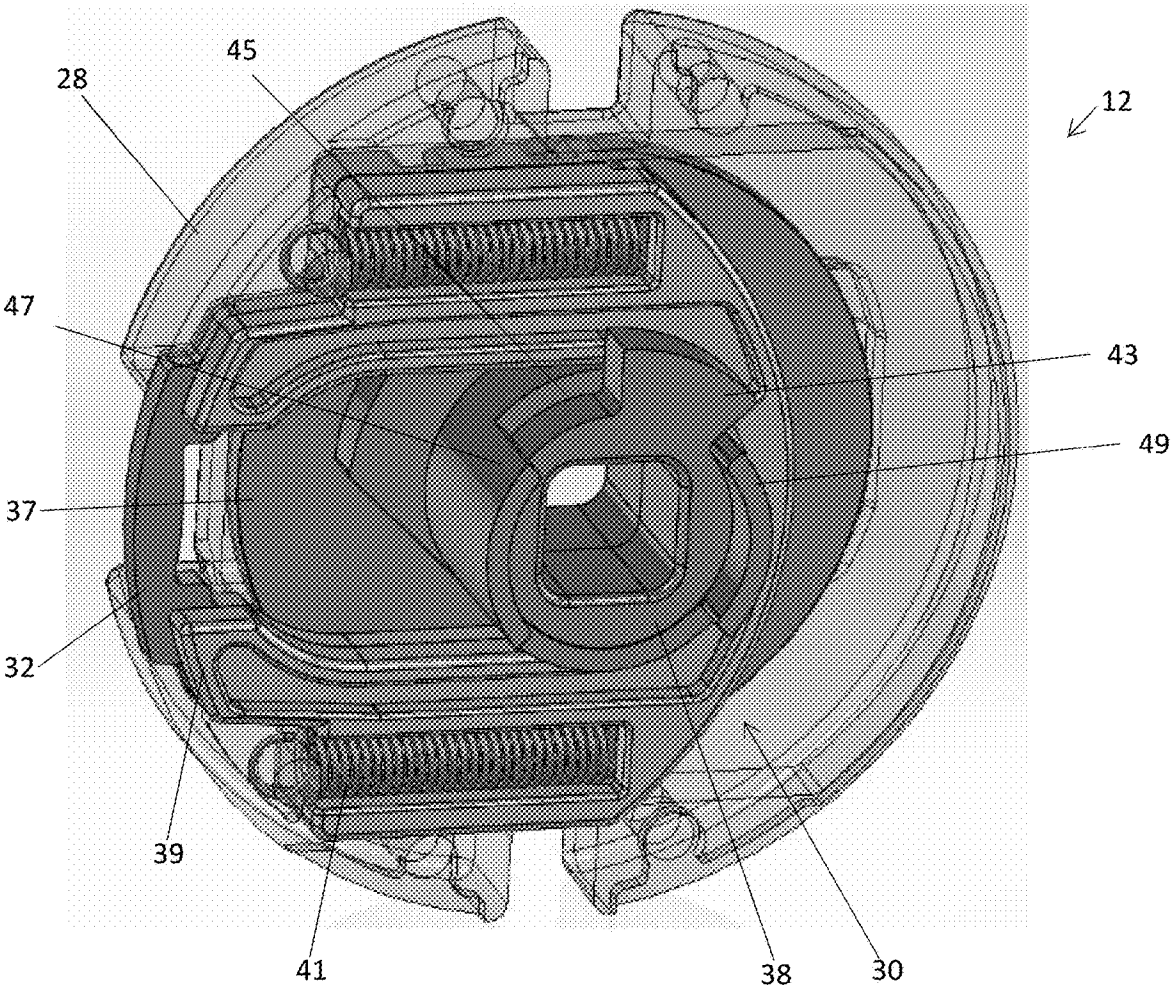
FIG. 3 shows a view of the latchbolt retractor of FIG. 1 with an example housing partially removed to reveal a latchbolt retraction mechanism.

A latchbolt retractor 12 comprises a latchbolt retraction mechanism 30 mounted to a carriage 28 that, in this but not necessarily in all embodiments, comprises a housing in which the latchbolt retraction mechanism 30 is housed. FIG. 3 shows a view of the latchbolt retractor 12 with the housing partially removed to reveal the latchbolt retraction mechanism 30. The latchbolt retraction mechanism 30 comprises a latchbolt assembly coupler 32 for operational coupling to the latchbolt assembly 22. The carriage 28 is configured to slide along the at least one rail 14,16 for positioning the latchbolt assembly coupler relative to the latchbolt. The latchbolt retractor 12 is transverse to the at least one rail 14,16. The latchbolt retractor is movably mounted on the at least one rail 14,16, and in this embodiment slidably mounted on the at least one rail 14,16. The carriage comprises at least one bearing 34,36, in this but not all embodiments a plurality of bearings (specifically two in this embodiment, but an alternative embodiment may have more or less bearings), configured to engage the at least one rail 14,16. The bearings 34, 36 each comprise a channel formed in the carriage. Each bearing 34, 36 is a plain bearing formed in the housing that engage a rail to form a prismatic joint, although other types of bearings, for example ball bearings, may be used.

The at least one rail 14,16 and the at least one bearing 34,36 are configured for a unique rotational orientation of the latchbolt retraction mechanism 30 about an axis parallel to the at least rail 14,16 when the at least one bearing 34,36 engages the at least one rail. In the present but not all embodiments, the configuration for the unique rotational orientation is as follows. The plurality of rails 34,36 have different lateral dimension. The plurality of bearings 34,36 each only fit a respective rail of the plurality of rails 14, 16. Consequently, the latchbolt retractor 12 may only be orientated one way with respect to the remainder of the assembly 10. In an alternative embodiment, however, a bearing and a rail may be configured such that the bearing may only be mounted on the rail in a unique rotational orientation, for example by having pentagon rails, triangular rails, or rails having an asymmetrical cross section.

The latchbolt retraction mechanism comprises a carriage 39 slidably mounted to the housing 28 to which the bar 32 is attached. The slidably mounted carriage 39 is outwardly biased by at least one biasing element in the form of an extension spring 41. Alternatively, the biasing element may be a compression spring or generally any suitable form of biasing element. The slidably mounted carriage 39 is operationally coupled via a rack-and-pinion arrangement to a cam 37 having the pinion and housed in the housing 28. The cam 37 is mounted to rotate around an axis of rotation. The carriage 39, which has the rack, is translated within the housing 28 by rotation of the cam 37 within the housing 28. The actuator 37 is mounted to rotate around the axis of rotation, and has a flange 43 located in an over-sized space 45 between two flange engagers 47, 49 of the cam 37 to provide a degree of lost motion. In another embodiment, the actuator 37 comprises the flange 43. Clockwise rotation of actuator 38 engages flange engager 49 and further rotation is transmitted to the flange engager 49 operating the cam 37 which is followed by the carriage 39, and the coupler latchbolt assembly coupler 32.

Figure 5:
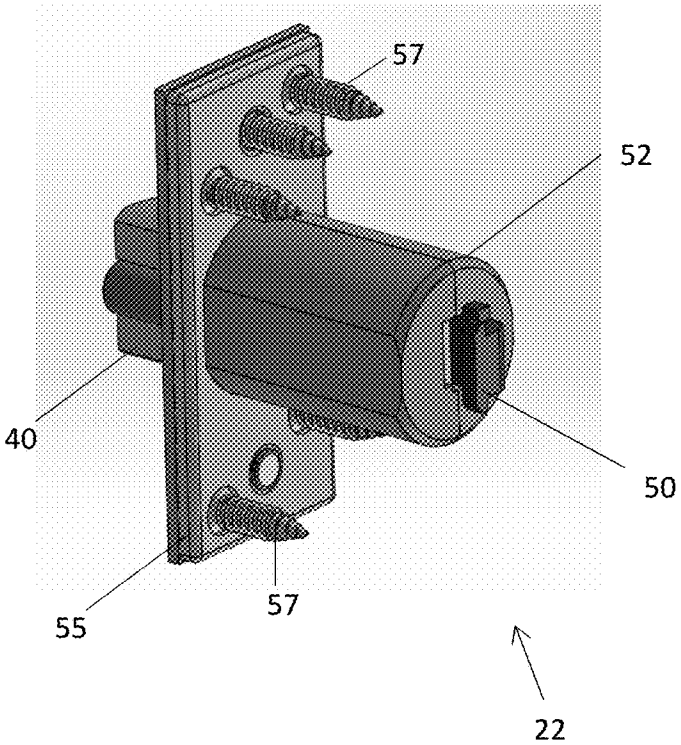
FIGS. 4 and 5 show front and rear perspective views of the latchbolt assembly of FIG. 2 respectively.
Figure 4:
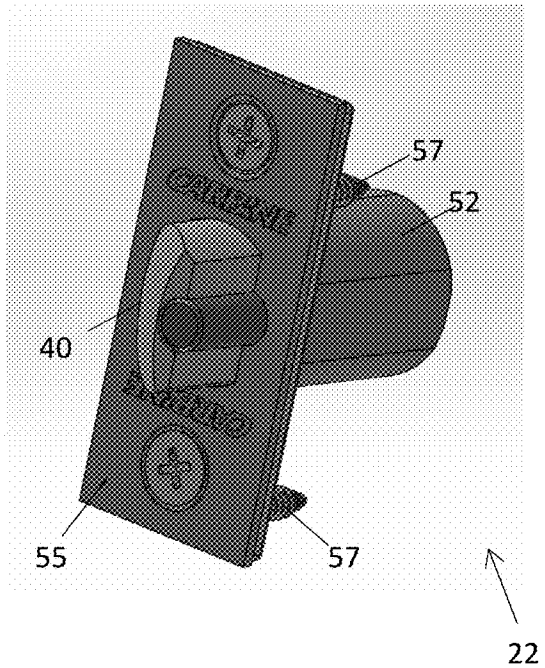

FIGS. 4 and 5 show front and rear perspective views of the latchbolt assembly 22. The latchbolt assembly 22 has a latchbolt assembly housing 52 and a facia plate 55 that in use is received in a shallow mortise formed in an edge of the hinged barrier and around an opening of the edge bore. The facia plate may be secured to the hinged barrier with fasteners in the form of, for example, screws 57.

Figure 6:
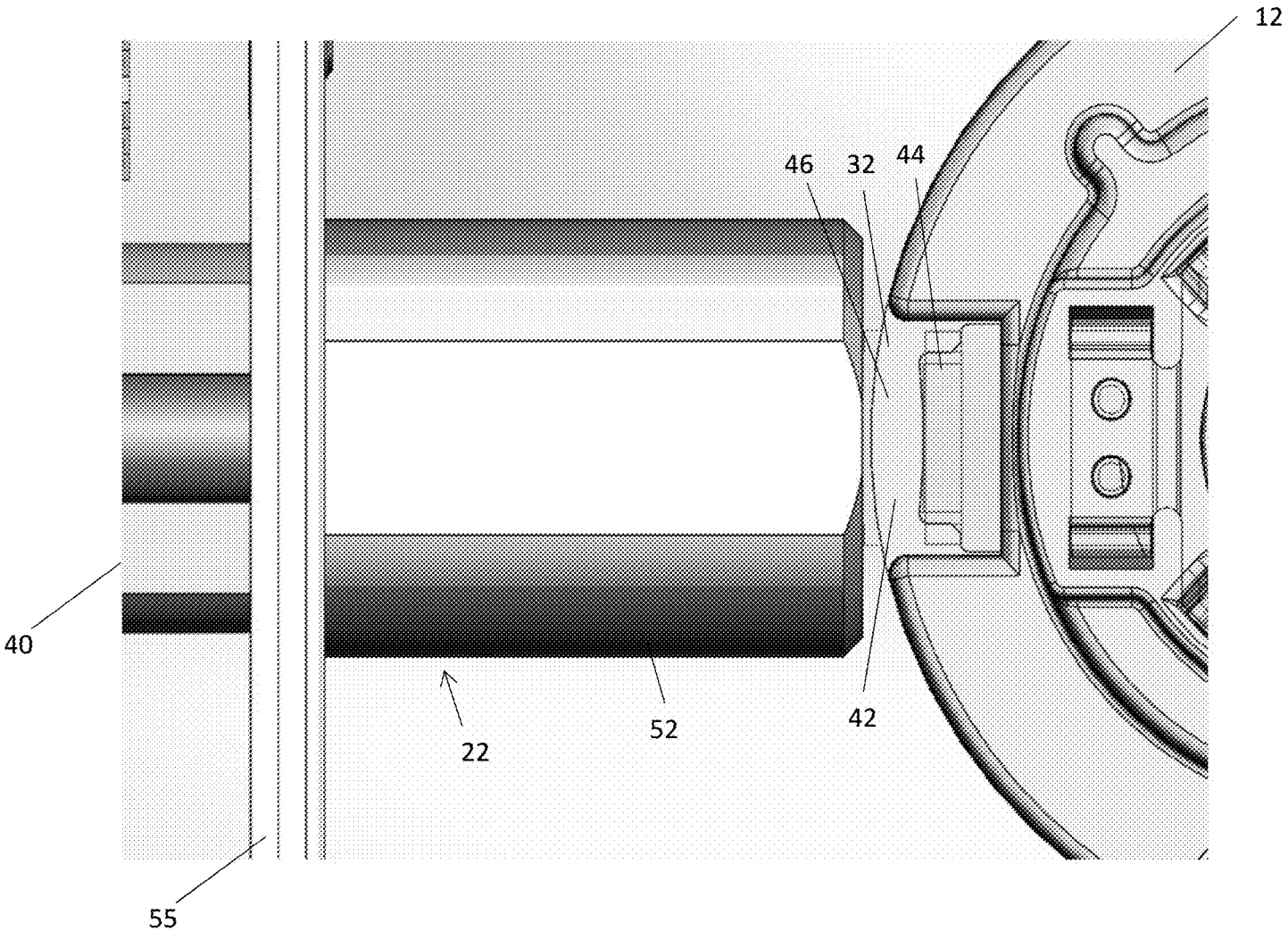
FIG. 6 shows an elevational view of the latchbolt assembly of FIG. 2 operationally coupled to the latchbolt retractor of FIG. 2.

FIG. 6 shows an elevational view of the latchbolt assembly 22 operationally coupled to the latchbolt retractor 12. The rotatable actuator 38 is configured to retract the latchbolt assembly coupler 32 when the rotatable actuator 38 is rotated in one direction only. The latchbolt retraction mechanism has a rack-and-pinion operationally coupling the rotatable actuator 38 to the latchbolt assembly coupler 32. Consequently, the unique rotational orientation of the latchbolt retraction mechanism 30 ensures that the latchbolt 40 is retracted when the handle is rotated in the one direction. For lever handles, for example, it is generally desirable for the lever to be generally orientated toward the hinges of the hinged barrier, and rotated downwards to retract the latchbolt 40.

Figure 7:
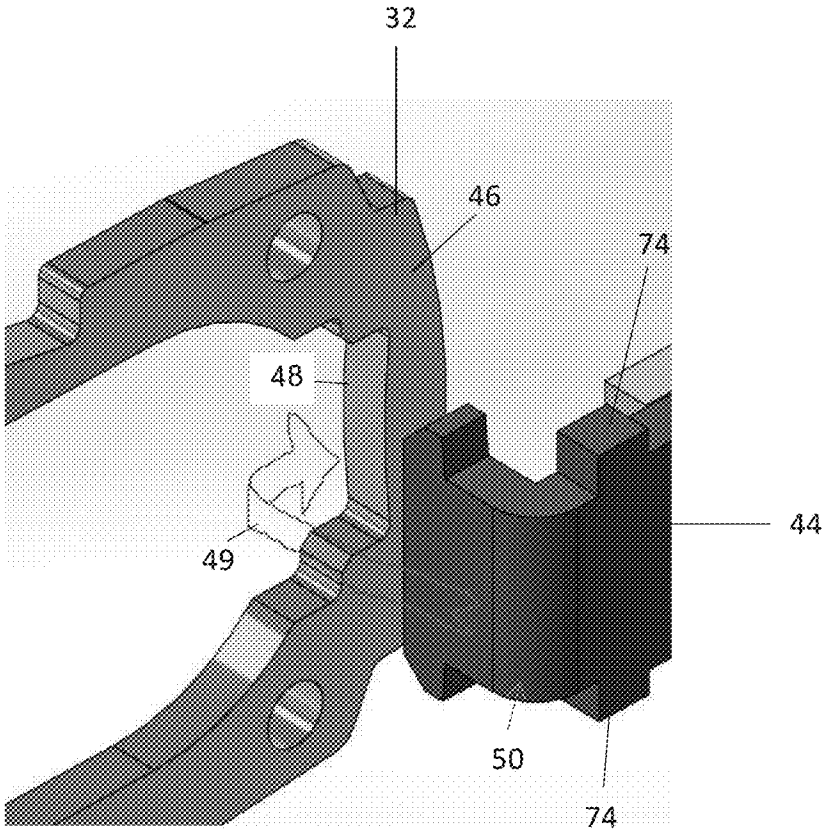
FIG. 7 show a detail of the latchbolt retractor coupler and a latchbolt assembly coupler.
Figure 8:
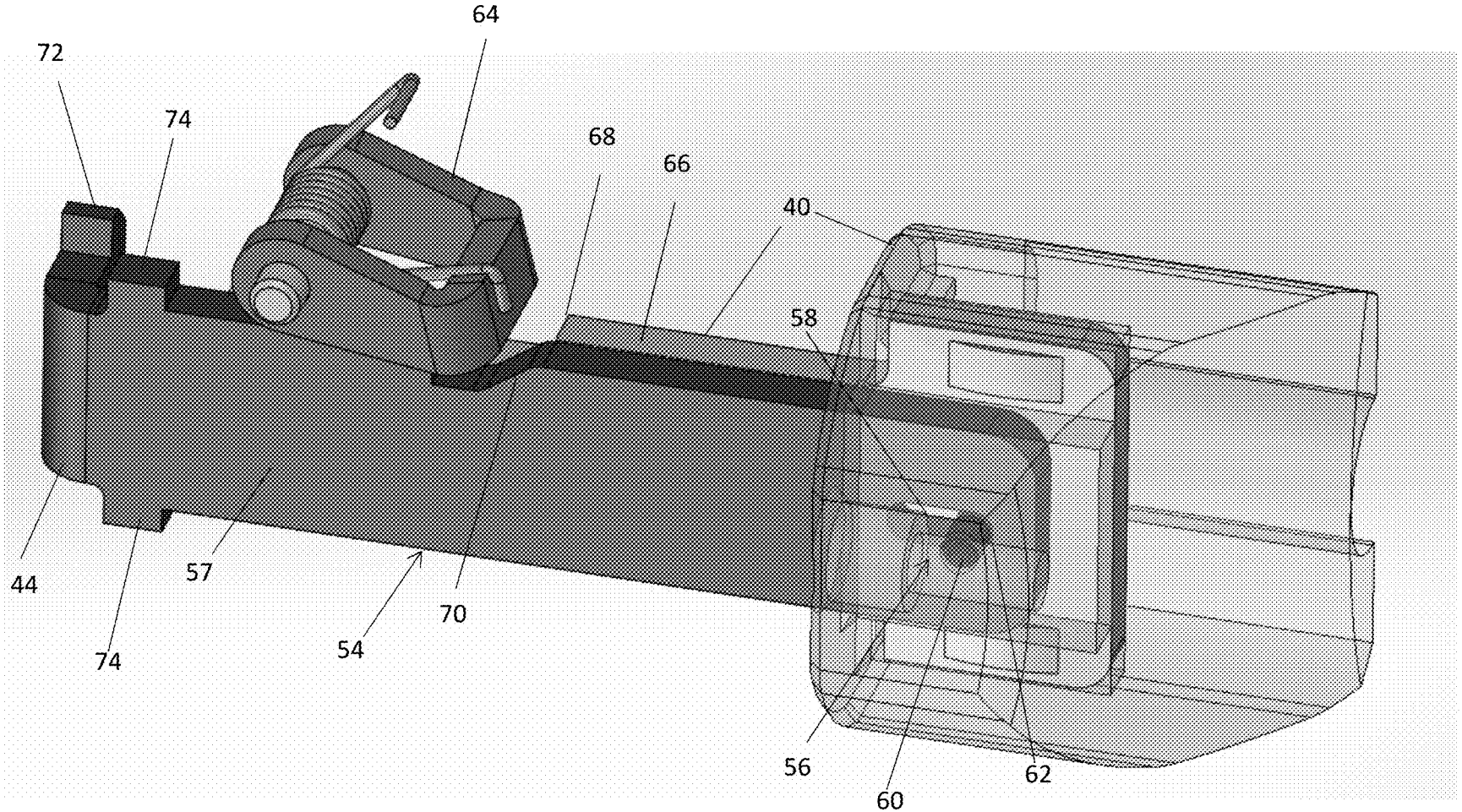
FIG. 8 shows a perspective view of parts within the latchbolt assembly of FIG. 2.

The latchbolt assembly 22 has a latchbolt retractor coupler 44 operationally coupled to the latchbolt assembly coupler 32. The latchbolt retractor coupler 44 is illustrated as a transparent part in FIG. 6 for clarity. FIG. 7 show a details of the latchbolt retractor coupler 44 and the latchbolt assembly coupler 32, wherein the couplers 32,44 are uncoupled. The arrow 49 indicates the method of coupling. FIG. 8 shows a perspective view of parts within the latchbolt assembly housing 52. The latchbolt assembly coupler 32 comprises a bar 46 having a convex surface 48 in the form of an inwardly orientated convex surface for pulling a hook 50 of the latchbolt actuator 54 of the latchbolt assembly 22. The hook 50 is hooked around the convex surface 48. A degree of rotation of the latchbolt retractor 12 around the axis of rotation of the rotatable actuator 38 may not significantly move the point of contact between the latchbolt assembly coupler 32 and latchbolt retractor coupler 44 because of the inwardly orientated convex surface. This may allow for some degree of misalignment between the latchbolt retractor 12 and the latchbolt assembly, which may make installation easier. In an alternative embodiment, the latchbolt retractor coupler 44 may comprise a convex surface—which may be outwardly facing—and the latchbolt assembly coupler 32 may comprise a hook. Control stops 74 are arranged to position the latch bolt 40 and the latch bolt actuator 54 relative the to housing 52.

Referring to FIG. 8, the latchbolt 40 (shown transparently for clarity) is joined to a latchbolt actuator 54. The latchbolt actuator 54 comprises a body in the form of an elongated plate 57. In this but not all embodiments, the latchbolt 40 comprises an elongated member 66 extending from a head of the latchbolt. The elongated member 66 is in the form of a plate parallel to the latchbolt actuator 54. The latchbolt actuator 54 is joined to the latchbolt 40 via a sliding joint 56. The joint comprises a pin 60 attached to the latchbolt 40 disposed in a slot 58 formed in the latchbolt actuator 54. The sliding joint 56 has a sliding limit wherein the pin 60 engages an end wall 62 of the slot 58 as shown in FIG. 8. The latchbolt actuator 54 is configured for operational coupling to the latchbolt retraction mechanism 12, in this embodiment by having the latchbolt retraction mechanism coupler 44 at an end thereof. The latchbolt assembly 22 has a movable stop 64 biased into the latchbolt actuator 54 and arranged to interfere with the latchbolt 40 to stop the latchbolt being moved inwardly, for example by a credit card pushed between a jamb and a door to which the lockset is mounted. The stop 64 is pivotally mounted within the latchbolt assembly housing 52 and biased by a biasing element in the form of a torsion spring. The stop may be mounted in any suitable way, for example with a rocking plate. The latchbolt actuator 54 is configured to move the movable stop 64 clear of the latchbolt 40 when operated and the sliding joint is approaching the sliding limit. The latchbolt 40 comprises a stop receiver in the form of an edge surface 68 and the latchbolt actuator comprises a ramp 70. The movable stop 64 is arranged to interfere with the stop receiver 68 to stop an inward movement of the latchbolt 40, and the ramp 70 is arranged to move the movable stop 64 clear of the stop receiver 68 when the latchbolt actuator 54 is operated and the sliding joint 56 is approaching the sliding limit.

The latchbolt retraction mechanism coupler 44 is configured to fix the position the latchbolt retraction mechanism 12 relative to the latchbolt assembly 22 when so coupled. The latchbolt retraction mechanism coupler 44 comprises at least one laterally displaced element 72. The latchbolt assembly coupler 32 of the latchbolt retraction mechanism 30 is received between the at least one laterally displaced element 72 and the elongated plate 57. The laterally displaced element 72 (and elongated plate 57) interferes with lateral displacement of latchbolt retraction mechanism 22 when so coupled.

Figure 9:
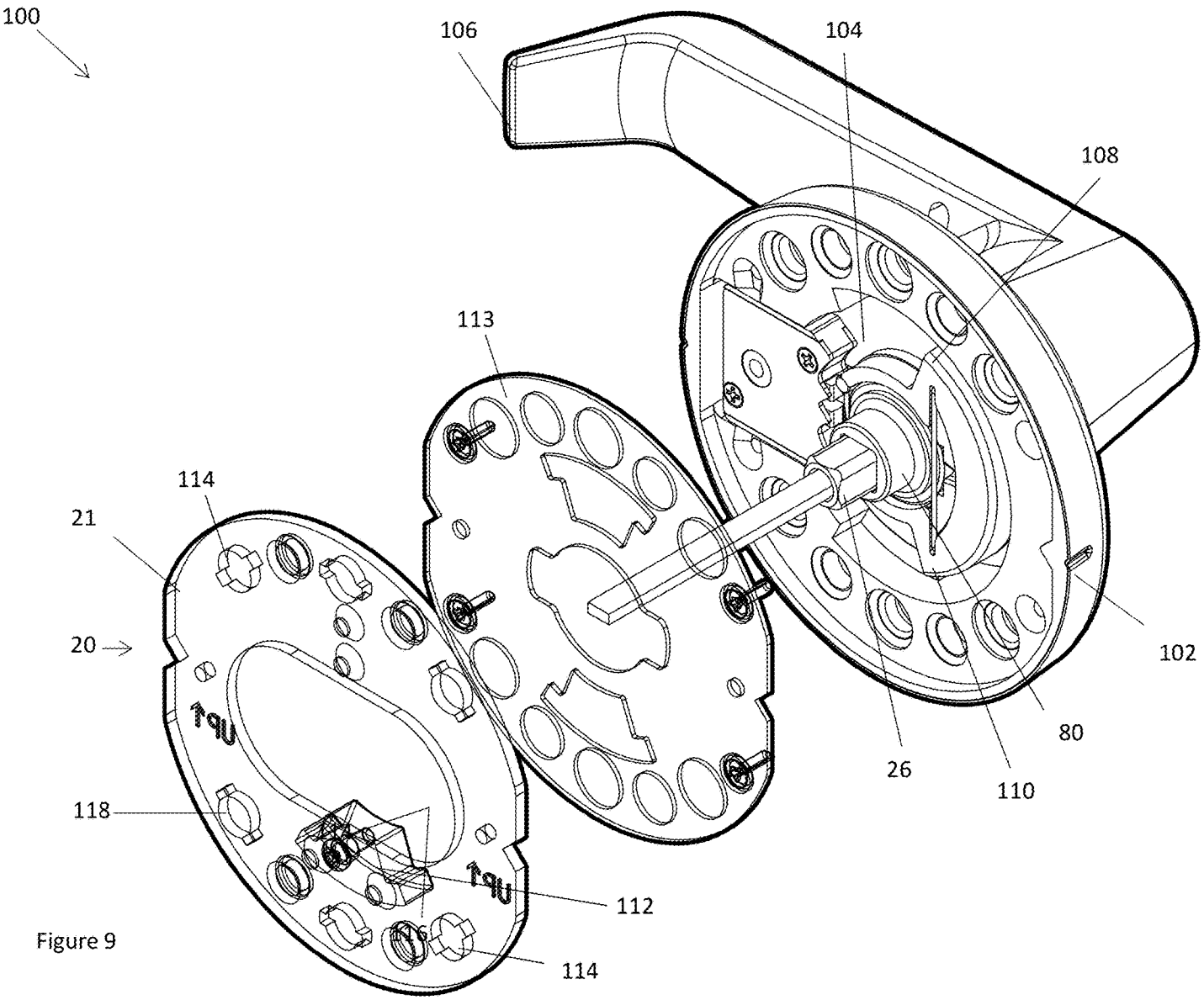
FIG. 9 shows a perspective view of another embodiment of an assembly for a lockset.

FIG. 9 shows a perspective view of another assembly for a lockset, the assembly being indicated by the numeral 100. The assembly 100 has a housing 102 comprising a rose. The assembly has a handle coupler 104 housed at least in part within the housing 102 and rotationally mounted thereto. The handle coupler is configured for a handle 106 to be coupled thereto, and transmit rotation of the handle 105 when so coupled. A closure in the form of a plate caps the handle coupler 104 and closes the housing 102. The assembly 100 has a plate 20 for mounting on a hinged barrier and having a preferred orientation relative to the hinged barrier when so mounted. The housing 102 is attachable to the plate 20 in an orientation and an inverted orientation. In this but not all embodiments, the plate 20 and the handle coupler 104 are configured to interfere to stop rotation of the handle coupler 104 in a direction when the housing 102 is attached in the orientation, and stop rotation of the handle coupler 104 in a counter-direction when the housing 102 is attached in the inverted orientation. One of the handle coupler 104 and the plate 20—in this but not all embodiments the handle coupler 104—comprises two interference members 108,110 and the other of the handle coupler 104 and the plate 20—in this but not all embodiments the plate 20—comprises a corresponding interference member 112 which is generally attached to the plate 20, as best understood with reference to FIG. 10. In this embodiment, the attached corresponding interference member 112 is attached to the plate body 21 by mechanical fastener 25, however it need not be—the interference member in the form of a stopper 112 may be integral to the plate body 21. In this embodiment, the fastener 25 comprises a screw, however any suitable fastener, for example a rivet or adhesive, may be used. A fire plate 23 is pressed against plate 20. Another plate 220, fire plate 223 and stopper 222 may be located on the other side of the hinged barrier for another handle 27.

Figure 10:
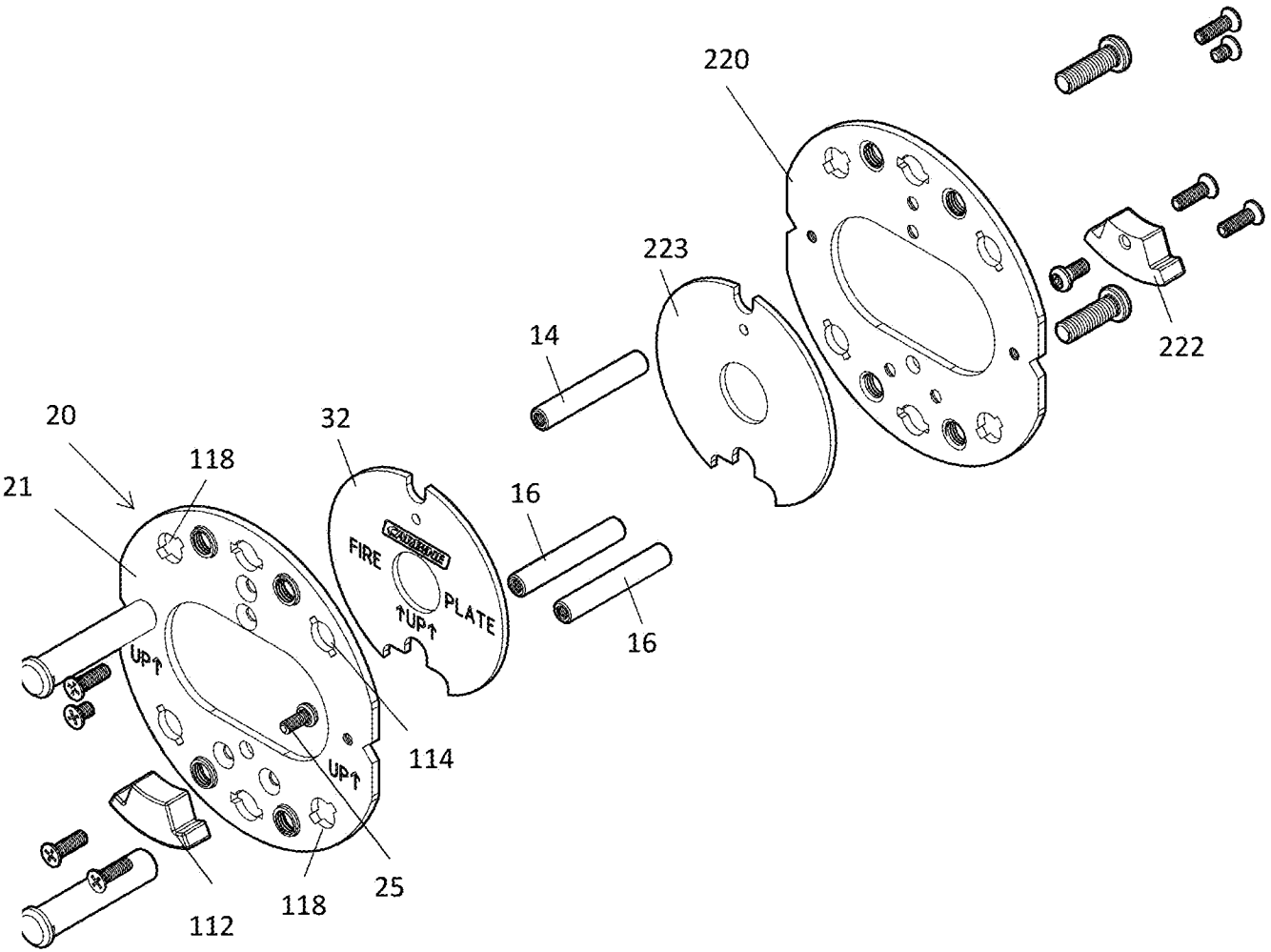
FIG. 10 shows a perspective view of example plates of the assembly for the lockset of FIG. 9.

When the housing 102 is attached in the orientation one of the two interference members 110 is disposed to interfere with the corresponding interference member 112 to stop rotation of the handle coupler 104 in a direction and when the housing is attached in the inverted orientation the other of the two interference members 108 is disposed to interfere with the corresponding interference member to stop rotation of the handle coupler 108 in the counter-direction. The two interference members 108, 110 are disposed at one side of the handle coupler 104, although in an alternative embodiment the interference members may be disposed at one side of the plate 20. The preferred orientation may be indicated on the plate 20, as it is in the present embodiment. As shown in FIGS. 1, 9 and 10, at least one arrow and the word "UP" are formed on the plate 20 to indicate the orientation of the plate 20 when installed on the hinged barrier.

The plate 20 has at least two apertures 114 for fasteners that fix the plate to a hinged barrier. The plate may be satisfactorily attached to the hinged barrier using two fasteners passed through two of the apertures 114. In the event that the material around holes formed in the hinged barrier in which the fasteners are located is damaged, for example by forced removal of the plate 20, the fasteners may be passed through other apertures 118 and into an undamaged material of the hinged barrier.

Figure 11:
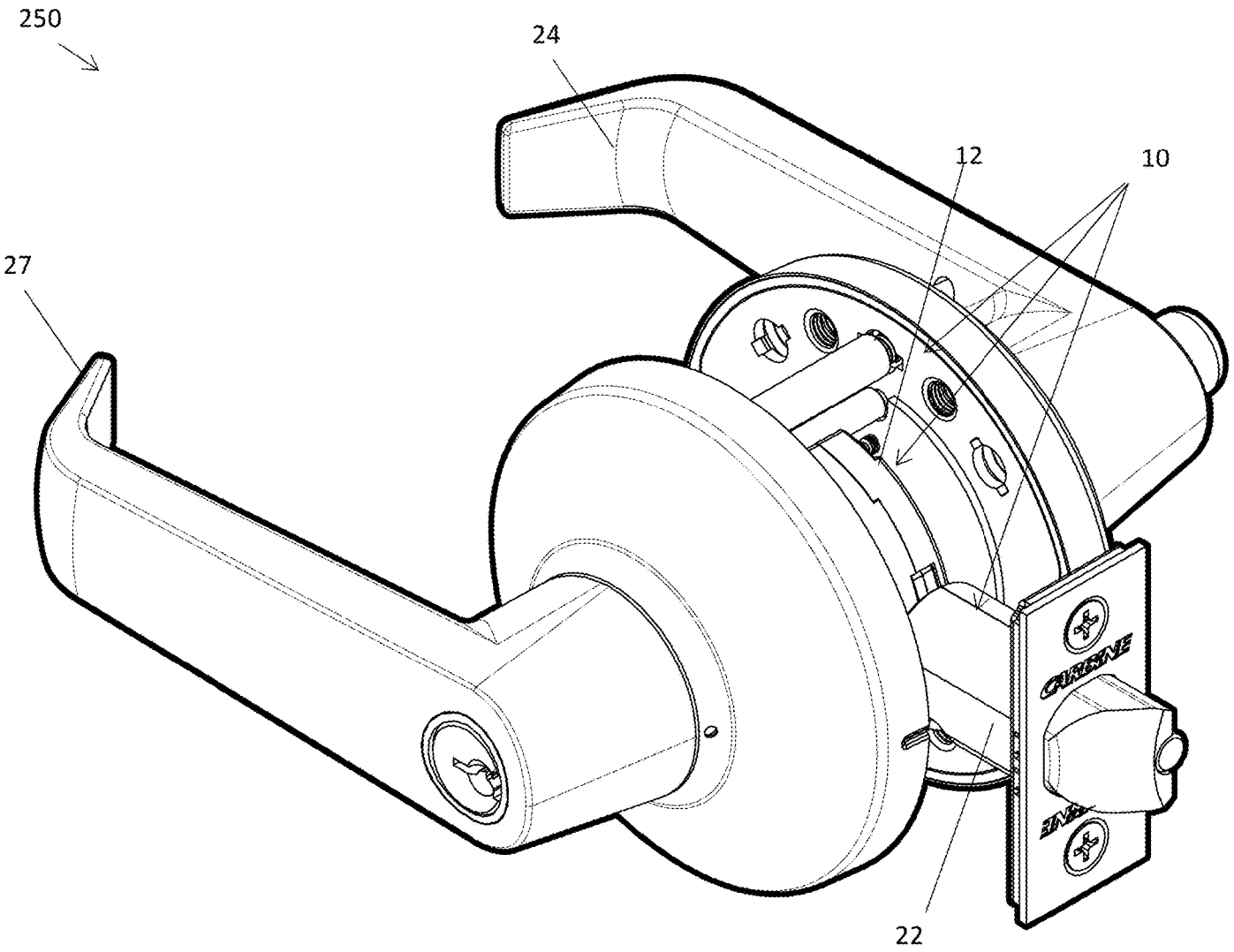
FIG. 11 shows a perspective view of an embodiment of a lockset.
Figure 12:
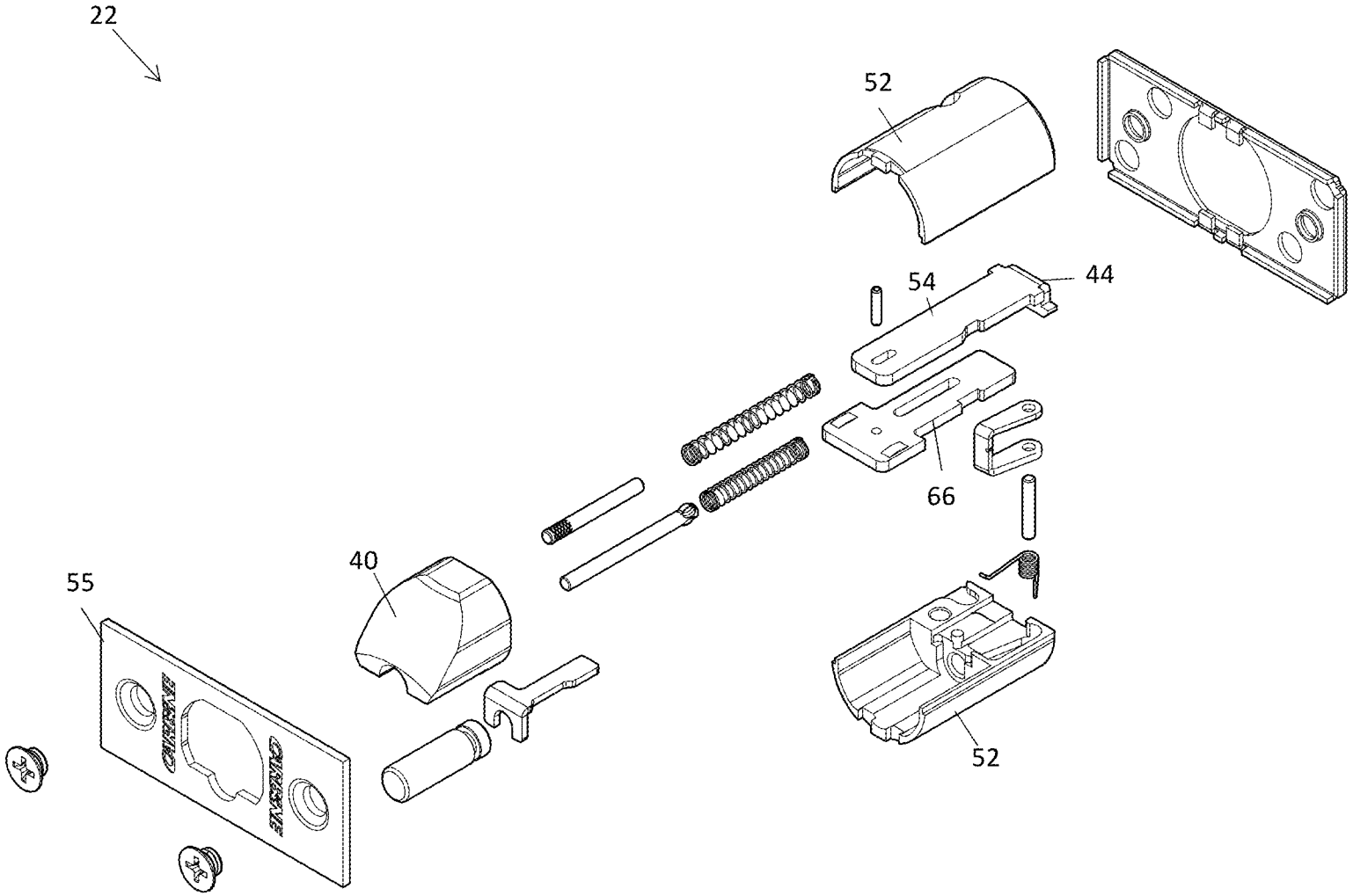
FIG. 12 shows an exploded view of the latchbolt assembly of FIG. 1.
Figure 13:
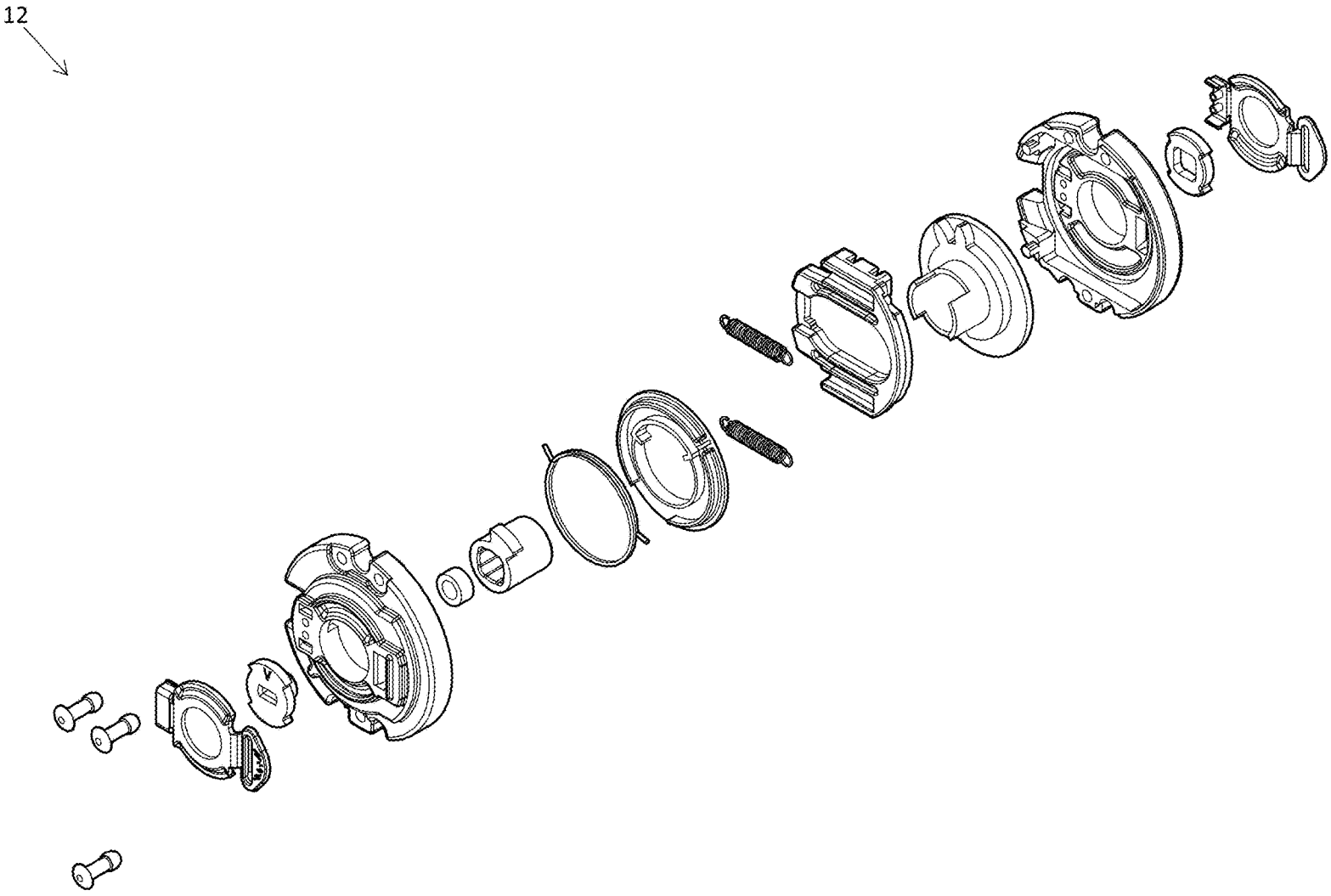
FIGS. 13 and 14 show alternative exploded perspective views of the latchbolt retractor 12.
Figure 14:
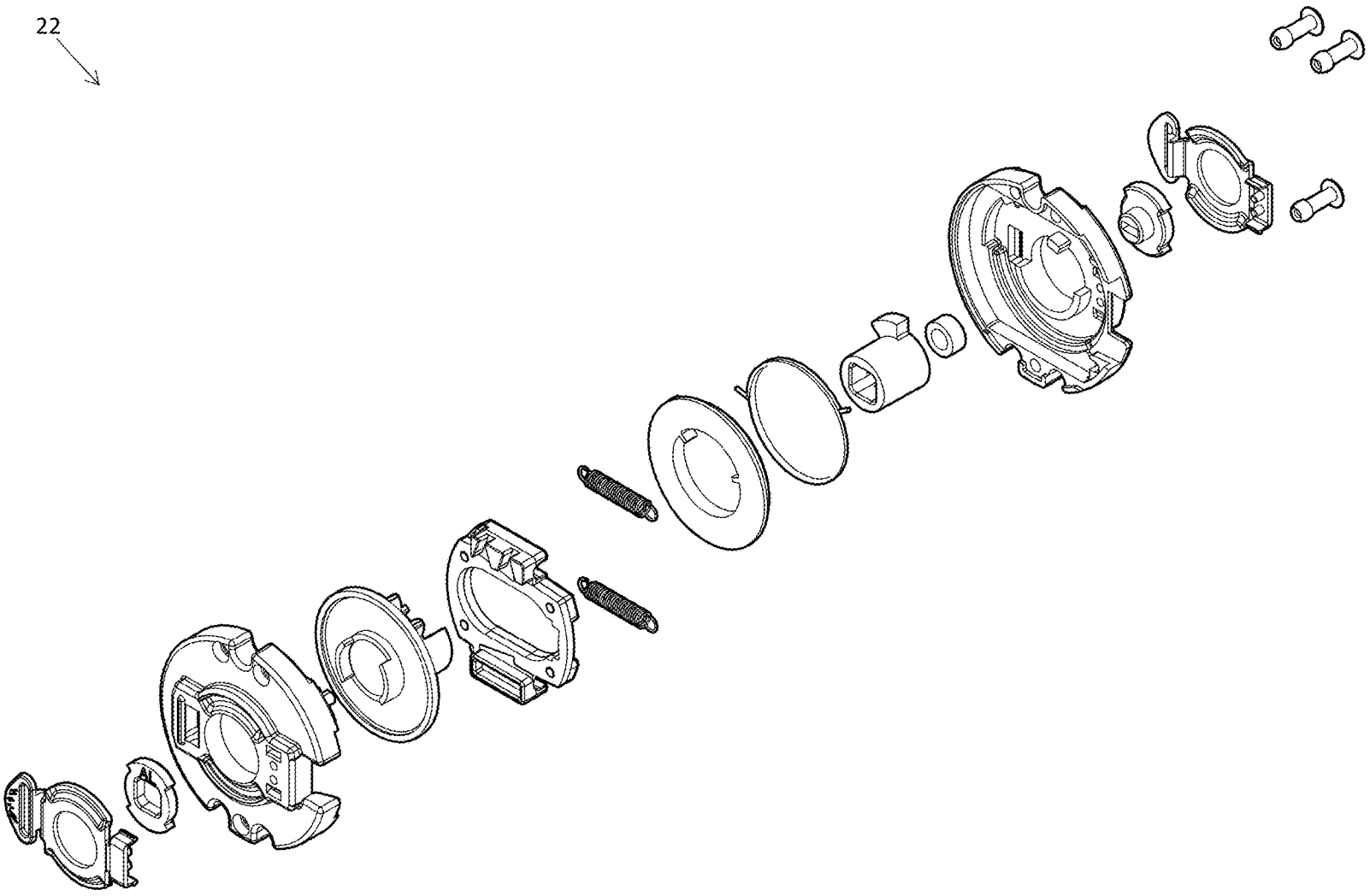

FIG. 11 shows a perspective view of an embodiment of a lockset 250 that may contains any one of the embodiments of a latchbolt retractor 12, a latchbolt assembly 22, and an assembly for a lockset 10 described above.

Figure 15:
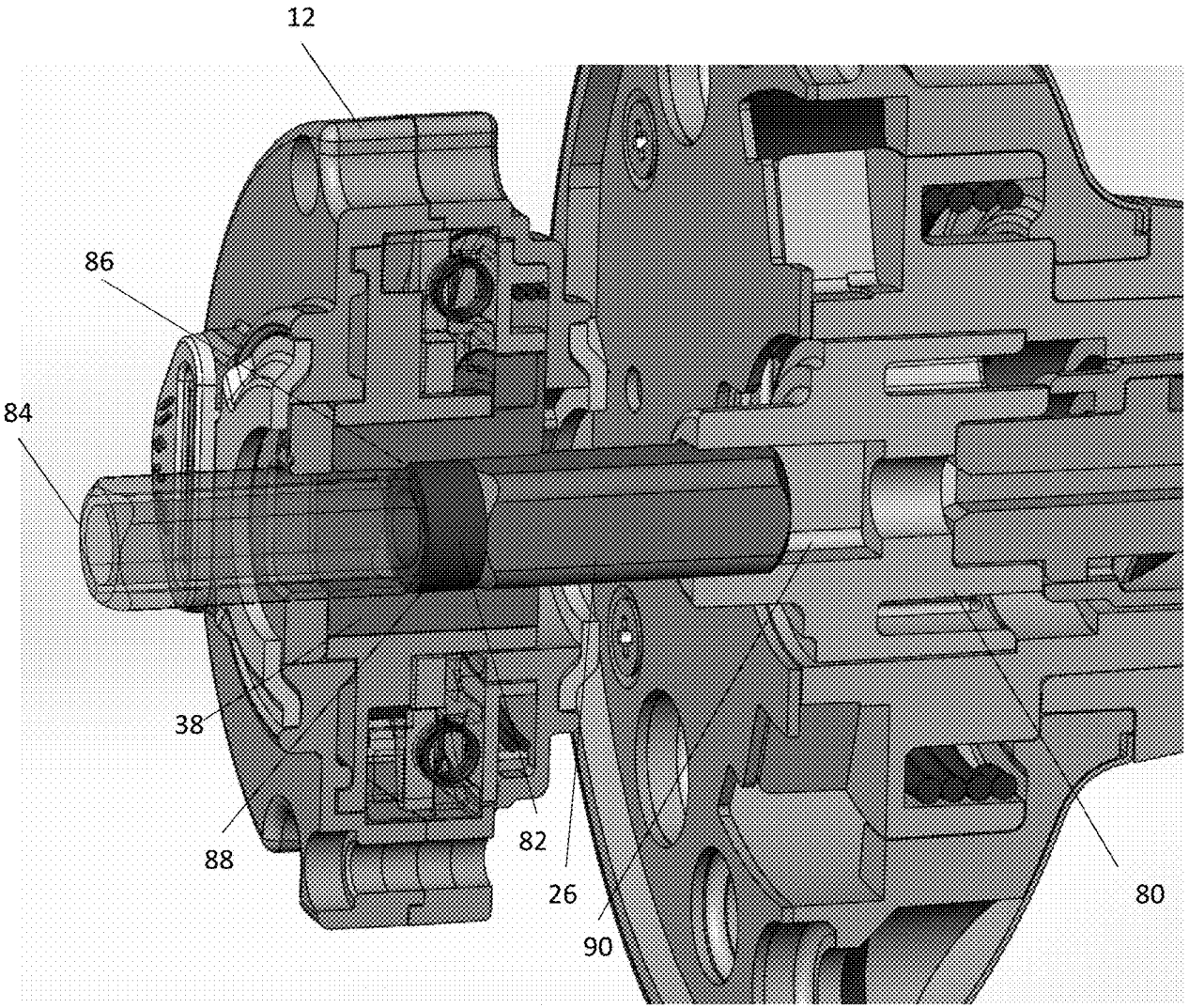
FIG. 15 shows a cut away perspective view of an example of a latchbolt retractor operationally coupled to an example of an actuator engager.

FIG. 15 shows a cut away perspective view of the latchbolt retractor 12 operationally coupled to an actuator engager 80 associated with the handle 12. The rotatable actuator 38 of the latchbolt retractor 12 has fixed therein a ferromagnetic element 82. Not all embodiments have the ferromagnetic element 82. The ferromagnetic element 82 is sandwiched between the latchbolt retractor actuator 26 and another latchbolt retractor actuator 84 associated with another handle. The other latchbolt retractor actuator 84 is shown transparently in FIG. 15 for illustrative purposes. The latchbolt retractor actuator 26 and the other latchbolt retractor actuator 84 are magnetically attracted to the ferromagnetic element 82. This is not the case in all embodiments, however. The actuator may be mechanically attached to the latchbolt retractor. In this embodiment the ferromagnetic element comprises a permanent magnet in the form of a rare earth magnet, however it may comprise any suitable magnetic material including ferrite or alnico. The latchbolt retractor actuator 26 and the other latchbolt actuator 84 may comprise generally any suitable ferromagnetic material, for example steel (as in the present embodiment), colt, or iron. Alternatively, in some but not all embodiments the latchbolt retractor actuators 26, 84 may be magnetic and the ferromagnetic element may not be a magnet. The ferromagnetic element 82 is, in this embodiment, press fitted into a passageway 88 of the rotatable actuator 38. A seat 86 in the form of a step is disposed in the passageway 88.

In some but not all embodiments, the ferromagnetic element 82 fixes the position of the latchbolt retractor actuators 26,84 relative to the latchbolt retractor 12, and prevents free floating of the latchbolt retractor actuators 26,84 within the passageway 88, which could result in the latchbolt retractor actuators 26, 84 from moving out of engagement with the rotatable actuator 38 by sliding into the cavity 90, for example. Without the magnetic attraction, repeated closing and opening of a door in which the lockset is installed, for example, may move the latchbolt retractor actuators out of engagement with the rotatable actuator 38.

Fixing the position of the latchbolt retractor actuators 26,84 relative to the latchbolt retractor allows door thickness variations to be accommodated with a smaller number of different latchbolt retractor actuator lengths, for example 2 instead of 4.

Now that embodiments have been described, it will be appreciated that some embodiments have at least some of the following advantages:

- The latchbolt retractor may be aligned with the edge bore and/or latchbolt assembly by moving the latchbolt retractor on the rails;
- The latchbolt retractor may be pulled into alignment by the latchbolt assembly;
- Misalignment between the latchbolt retractor and the latchbolt assembly may be accommodated by the use of curved surfaces; and
- The direction of rotation of the handle can be controlled.

Variations and/or modifications may be made to the embodiments described without departing from the spirit or ambit of the invention. The present embodiments are, therefore, to be considered in all respects as illustrative and not restrictive.

Prior art, if any, described herein is not to be taken as an admission that the prior art forms part of the common general knowledge in any jurisdiction.

In the claims which follow and in the preceding description of the invention, except where the context requires otherwise due to express language or necessary implication, the word "comprise" or variations such as "comprises" or "comprising" is used in an inclusive sense, that is to specify the presence of the stated features but not to preclude the presence or addition of further features in various embodiments of the invention.

The invention claimed is:

1. An assembly comprising:

a latchbolt retractor that comprises:

a carriage;

a latchbolt retraction mechanism mounted to the carriage, the latchbolt retraction mechanism comprising a latchbolt assembly coupler and a latchbolt assembly disposed in an edge bore of a hinged barrier, the latch bolt assembly comprising a latchbolt actuator and a latchbolt retractor coupler operationally coupled to the latchbolt assembly coupler, wherein the carriage and the latchbolt retraction mechanism are configured for the carriage to slide along at least one rail extending between two plates attached to opposite sides of the hinged barrier and position the latchbolt assembly coupler for operationally coupling with the latchbolt assembly disposed in the edge bore;

wherein the latchbolt assembly coupler comprises a bar having an inwardly orientated convex surface for pulling a hook of a latchbolt actuator of the latchbolt assembly; and wherein the hook is hooked around the inwardly oriented convex surface such that a degree of rotation of the latchbolt retractor around an axis of rotation of the rotatable actuator does not move the point of contact between the latchbolt assembly coupler and latchbolt retractor coupler;

wherein, the latchbolt assembly further comprises:

a latchbolt operationally connected to the latchbolt actuator via a sliding joint;

an elongated member extending from the latchbolt and defining a stop surface;

the latchbolt actuator defining a release surface; and a movable stop biased into the latchbolt actuator and arranged to interfere with the stop surface to stop an inward movement of the latchbolt, wherein the release surface is configured to move the movable stop clear of the stop surface when the latchbolt actuator is operated and the sliding joint is approaching a sliding limit; and a handle assembly comprising:

a housing;

a handle coupler within the housing and configured for a handle to be coupled thereto and transmit rotation of the handle to the latchbolt retraction mechanism when so coupled; and a plate for mounting on a hinged barrier and having a preferred orientation relative to the hinged barrier when so mounted, the housing being attachable to the plate in an orientation or an inverted orientation, wherein the handle coupler comprises first and second interference members and the plate comprises a plate interference member, wherein when the housing is attached in the orientation, the plate interference member is configured to be received within a first receiving area on the housing to interfere with the first interference member of handle coupler to stop rotation of the handle coupler in a direction, and when the housing is attached in the inverted orientation, the plate interference member is configured to be received within a second receiving area on the housing to interfere with the second interference member to stop rotation of the handle coupler in the counter-direction.

2. A latchbolt retractor defined by claim 1 wherein the carriage comprises at least one bearing configured to engage a respective one of the at least one rail.

3. A latchbolt retractor defined by claim 2 wherein the at least one rail and the at least one bearing are configured for a unique rotational orientation of the latchbolt retraction mechanism about an axis parallel to the at least rail when the at least one bearing engages the at least one rail.

4. A latchbolt retractor defined by claim 3 wherein the latchbolt retraction mechanism comprises a rotatable actuator and is configured to retract the latchbolt assembly coupler when the rotatable actuator is rotated in one direction only.

5. A latchbolt retractor defined by claim 1 wherein the latchbolt retraction mechanism is configured to be operationally coupled to a handle.

6. A latchbolt retractor defined by claim 2 wherein the carriage comprises a carriage housing in which the retraction mechanism is mounted.

7. A latchbolt retractor defined by claim 6 wherein the at least one bearing is formed in the housing.

8. A latchbolt retractor defined by claim 1 wherein the at least one rail comprises a plurality of rails and the carriage comprises a plurality of bearings configured to engage the plurality of rails.

9. A latchbolt retractor defined by claim 8 wherein the plurality of bearings each only fit a respective rail of the plurality of rails.

10. An assembly for a lockset, the assembly comprising:

a latchbolt retractor defined by claim 1 mounted on the at least one rail;

the at least one rail extending between two plates configured to be attached to opposite sides of a hinged barrier; and a latchbolt assembly operationally coupled to the latchbolt retractor.

11. An assembly comprising:

a latchbolt assembly that comprises:

a latchbolt;

a latchbolt actuator joined to the latchbolt via a sliding joint having a sliding limit and a pin attached to the latchbolt, the pin being disposed in a slot formed in the latchbolt actuator such that the pin engages an end wall of the slot, the latchbolt actuator being in the form of an elongated plate and being configured for operational coupling to a latchbolt retraction mechanism;

an elongated member extending from the latchbolt and defining a stop receiver in the form of an edge surface;

a ramp provided on the latchbolt actuator; and a movable stop biased into the latchbolt actuator and arranged to interfere with the stop receiver to stop an inward movement of the latchbolt, wherein the ramp is configured to move the movable stop clear of the stop receiver when the latchbolt actuator is operated and the sliding joint is approaching the sliding limit;

a latchbolt retraction mechanism operatively connected to the latchbolt actuator; and a handle assembly comprising:

a housing;

a handle coupler housed at least in part within the housing and rotationally mounted thereto, and configured for a handle to be coupled thereto and transmit rotation of the handle to the latchbolt retraction mechanism when so coupled; and a plate for mounting on a hinged barrier and having a preferred orientation relative to the hinged barrier when so mounted, the housing being attachable to the plate in an orientation or an inverted orientation, wherein the handle coupler comprises first and second interference members and the plate comprises a plate interference member, wherein when the housing is attached in the orientation, the plate interference member is configured to be received within a first receiving area on the housing to interfere with the first interference member of handle coupler to stop rotation of the handle coupler in a direction, and when the housing is attached in the inverted orientation, the plate interference member is configured to be received within a second receiving area on the housing to interfere with the second interference member to stop rotation of the handle coupler in the counter-direction.

12. A latchbolt assembly defined by claim 11 wherein the latchbolt actuator comprises a latchbolt retraction mechanism coupler for operationally coupling to the latchbolt retraction mechanism, and the latchbolt retraction mechanism coupler is configured to fix the position the latchbolt retraction mechanism relative to the latchbolt assembly when so coupled.

13. A latchbolt assembly defined by claim 12 wherein the latchbolt retraction mechanism coupler comprises at least one laterally displaced element and a latchbolt assembly coupler of the latchbolt retraction mechanism is received between the at least one laterally displaced element and a body of the latchbolt actuator, the at least one laterally displaced element and the body of the latchbolt actuator interfering with lateral displacement of latchbolt retraction mechanism when so coupled.

14. An assembly defined by claim 10 wherein the latchbolt assembly is defined by claim 11.

* * * * *